US012410819B2

(12) United States Patent
Yu et al.

(10) Patent No.: US 12,410,819 B2
(45) Date of Patent: Sep. 9, 2025

(54) AIR GUIDE COVER, OUTDOOR UNIT OF HVAC APPARATUS, AND HVAC APPARATUS

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Dongdong Yu, Foshan (CN); Yandong Wu, Foshan (CN); Yuefei Li, Foshan (CN); Lihua Ma, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 0 days.

(21) Appl. No.: 18/890,086

(22) Filed: Sep. 19, 2024

(65) Prior Publication Data

US 2025/0101993 A1 Mar. 27, 2025

(30) Foreign Application Priority Data

Sep. 25, 2023 (CN) ..... 202311245891.2

(51) Int. Cl.
*F04D 29/42* (2006.01)
*F04D 29/66* (2006.01)

(52) U.S. Cl.
CPC ..... *F04D 29/667* (2013.01); *F04D 29/4226* (2013.01)

(58) Field of Classification Search
CPC ..... F04D 29/667; F04D 29/403; F24F 1/48; F24F 13/081; F24F 13/24; F24F 2013/247
See application file for complete search history.

(56) References Cited

U.S. PATENT DOCUMENTS 9,822,801 B2 * 11/2017 Nakagawa ..... F04D 29/542
10,801,518 B2 * 10/2020 Nakashima ..... F04D 29/665

* cited by examiner

*Primary Examiner* — Sabbir Hasan
(74) *Attorney, Agent, or Firm* — Anova Law Group, PLLC

(57) ABSTRACT

An air guide cover including an air outlet, an air guide channel configured to house a fan of an outdoor unit of an HVAC apparatus, and an air inlet communicated with the air outlet through the air guide channel. At least one of an inner wall of the air inlet, an inner wall of the air outlet, or an inner wall of the air guide channel is provided with a flow-disturbance structure. The flow-disturbance structure includes at least one of a protrusion part or a cutting plane part.

17 Claims, 6 Drawing Sheets

AIR GUIDE COVER, OUTDOOR UNIT OF HVAC APPARATUS, AND HVAC APPARATUS

CROSS-REFERENCE TO RELATED APPLICATION

This application claims priority to Chinese Application No. 202311245891.2, filed on Sep. 25, 2023, the entire content of which is incorporated herein by reference.

TECHNICAL FIELD

The present disclosure relates to the technical field of HVAC (Heating, Ventilation and Air Conditioning) apparatuses, and in particular to an air guide cover, an outdoor unit of an HVAC apparatus, and an HVAC apparatus.

BACKGROUND

This section only provides background information related to the present disclosure, which is not necessarily related art.

When an existing outdoor unit of an HVAC apparatus is in operation, a fan rotates to achieve heat exchange between a heat exchanger and an external airflow. An air guide cover is provided on a radial outer side of the fan to collect the airflow through the air guide cover and increase the velocity of airflow.

In the related art, low-frequency noise will be generated when the airflow passes through the air guide cover, which reduces the comfort of the user during use and thus lowers the user experience.

SUMMARY

An object of the present disclosure is to at least address the issue of how to reduce the low-frequency noise of the air guide cover, and this object is achieved through the following technical solutions.

A first aspect of the present disclosure proposes an air guide cover, which is used for an outdoor unit of an HVAC apparatus, and which includes an air inlet, an air guide channel, and an air outlet; the air guide channel is configured to house a fan of the outdoor unit of the HVAC apparatus, and the air inlet is communicated with the air outlet through the air guide channel; at least one of an inner wall of the air inlet, an inner wall of the air outlet, or an inner wall of the air guide channel is provided with a flow-disturbance structure, which includes at least one of a protrusion part and a cutting plane part.

In the air guide cover according to the present disclosure, when the air guide cover is used for the outdoor unit of the HVAC apparatus, the fan of the outdoor unit of the HVAC apparatus is rotatably arranged in the air guide channel of the air guide cover. When the fan rotates, air enters the air guide channel from the air inlet and is discharged through the air outlet, and heat exchange occurs between the flowing airflow and the outdoor unit of the HVAC apparatus. When the airflow is driven by the fan to pass through the air guide cover, due to the presence of the flow-disturbance structure provided on at least one of the inner wall of the air outlet, the inner wall of the air inlet and the inner wall of the air guide channel, an interior of the air guide cover has a structural change in its radial direction, so that the frequency of regular interference of the rotating fan with surrounding objects is increased, the frequency of the low-frequency noise accumulated by the rotation of the fan is increased, and the spikes of the rotating noise in the same frequency band are reduced, thereby reducing the low-frequency noise during use and effectively improving the user experience.

In addition, the air guide cover according to the present disclosure may also have the following additional technical features.

In some embodiments of the present disclosure, the air guide channel is a cylindrical channel, and the air outlet is a first horn mouth; an inclination direction of the inner wall of the first horn mouth is set at a first angle a1 with an axis of the air guide channel, and the flow-disturbance structure includes a first flow-disturbance structure arranged on the inner wall of the first horn mouth.

In some embodiments of the present disclosure, the first flow-disturbance structure has a first air guide plane, which is arranged facing the axis of the air guide channel and is set at a second angle a with the axis of the air guide channel, where $0° \leq a < a1$.

In some embodiments of the present disclosure, the first angle a1 is larger than 0°, and the first angle a1 is smaller than or equal to 60°; and/or the first air guide plane is arranged in parallel with the axis of the air guide channel, a distance between the first air guide plane and the axis of the air guide channel is x, and a radius of the air guide channel is R, where $0 \leq x < R$; and/or in a radial direction of the air guide channel, the first air guide plane has a radial size d, and a diameter of the air guide channel is D, where $0 < d < 0.5D$.

In some embodiments of the present disclosure, the number of the first flow-disturbance structures is N, where N is a positive integer larger than or equal to 1, and the number of fan blades of the fan is n, where n is a positive integer larger than or equal to 1, and $0.2n < N < 50n$.

In some embodiments of the present disclosure, the number of the first flow-disturbance structures is multiple, and all the first flow-disturbance structures are arranged at intervals in a circumferential direction of the air guide channel; and/or the first flow-disturbance structures are cutting plane parts formed on an inner wall surface of the first horn mouth.

In some embodiments of the present disclosure, the air guide channel is a cylindrical channel, the air inlet is a second horn mouth, and an inclination direction of the inner wall of the second horn mouth is set at a third angle b1 with an axis of the air guide channel.

In some embodiments of the present disclosure, a second flow-disturbance structure is arranged on the inner wall of the second horn mouth, and the second flow-disturbance structure has a second air guide plane, which is arranged facing the axis of the air guide channel and is set at a fourth angle b with the axis of the air guide channel, where $0° \leq b < b1$.

In some embodiments of the present disclosure, the third angle b1 is larger than 0°, and the third angle b1 is smaller than or equal to 60°; and/or the second air guide plane is arranged in parallel with an axis of the air guide channel, a distance between the second air guide plane and the axis of the air guide channel is y, and a radius of the air guide channel is R, where $0 \leq y < R$; and/or in a circumferential direction of the air guide channel, the second air guide plane has a circumferential size L, and the perimeter of the air guide channel is L1, where $0.1L1 < L < L1$.

In some embodiments of the present disclosure, the number of the second flow-disturbance structures is M, where M is a positive integer larger than or equal to 1, and the number of fan blades of the fan is n, where n is a positive integer larger than or equal to 1, and $0.2n<M<50n$.

In some embodiments of the present disclosure, the number of the second flow-disturbance structures is multiple, and all the second flow-disturbance structures are arranged at intervals in a circumferential direction of the air guide channel; and/or the second flow-disturbance structures are protrusion parts, and connection surfaces between the protrusion parts and the inner wall of the second horn mouth are rectangular, trapezoidal, or triangular.

In some embodiments of the present disclosure, the flow-disturbance structure includes a first flow-disturbance structure and a second flow-disturbance structure; the air outlet is a first horn mouth and is provided with four said first flow-disturbance structures, which are arranged at equal intervals in a circumferential direction of the air guide channel; the first flow-disturbance structure is a cutting plane part formed on the inner wall surface of the first horn mouth, and the cutting plane part has a first air guide plane; an angle between the inner wall surface of the first horn mouth and the inner wall surface of the air guide channel is 10°, and an angle between the first air guide plane and the axis of the air guide channel is 0°; in a radial direction of the air guide channel, a radial size of the first air guide plane is larger than 0 and smaller than a radius of the air guide channel; and the air inlet is a second horn mouth and is provided with four said second flow-disturbance structures, which are arranged at equal intervals in the circumferential direction of the air guide channel; the second flow-disturbance structure is a protrusion part formed on the inner wall surface of the second horn mouth, and the protrusion part has a second air guide plane; an angle between the inner wall surface of the second horn mouth and the inner wall surface of the air guide channel is 30°, and an angle between the second air guide plane and the axis of the air guide channel is 0°; in the circumferential direction of the air guide channel, a circumferential size of the second air guide plane is larger than 0.1 times the perimeter of the air guide channel and smaller than the perimeter of the air guide channel.

A second aspect of the present disclosure proposes an outdoor unit of an HVAC apparatus, which includes:

a cabinet;

a heat exchanger, which is arranged inside the cabinet;

the air guide cover as described above, which is installed on the cabinet and located at the top of the heat exchanger; and a fan, which is rotatably arranged in the air guide channel of the air guide cover.

In the outdoor unit of the HVAC apparatus according to the present disclosure, the fan is rotatably arranged in the air guide channel of the air guide cover. When the fan rotates, air enters the air guide channel from the air inlet and is discharged through the air outlet, and heat exchange occurs between the flowing airflow and the outdoor unit of the HVAC apparatus. When the airflow is driven by the fan to pass through the air guide cover, due to the presence of the flow-disturbance structure provided on at least one of the inner wall of the air outlet, the inner wall of the air inlet and the inner wall of the air guide channel, an interior of the air guide cover has a structural change in its radial direction, so that the frequency of regular interference of the rotating fan with surrounding objects is increased, the frequency of the low-frequency noise accumulated by the rotation of the fan is increased, and the spikes of the rotating noise in the same frequency band are reduced, thereby reducing the low-frequency noise during use and effectively improving the user experience.

A third aspect of the present disclosure proposes an HVAC apparatus, which includes the outdoor unit of an HVAC apparatus as described above.

In the HVAC apparatus according to the present disclosure, the fan of the outdoor unit of the HVAC apparatus is rotatably arranged in the air guide channel of the air guide cover. When the fan rotates, air enters the air guide channel from the air inlet and is discharged through the air outlet, and heat exchange occurs between the flowing airflow and the outdoor unit of the HVAC apparatus. When the airflow is driven by the fan to pass through the air guide cover, due to the presence of the flow-disturbance structure provided on at least one of the inner wall of the air outlet, the inner wall of the air inlet and the inner wall of the air guide channel, an interior of the air guide cover has a structural change in its radial direction, so that the frequency of regular interference of the rotating fan with surrounding objects is increased, the frequency of the low-frequency noise accumulated by the rotation of the fan is increased, and the spikes of the rotating noise in the same frequency band are reduced, thereby reducing the low-frequency noise during use and effectively improving the user experience.

BRIEF DESCRIPTION OF THE DRAWINGS

Upon reading the detailed description of embodiments below, various other advantages and benefits will become clear to those skilled in the art. The accompanying drawings are only used for the purpose of illustrating some embodiments, and should not be considered as a limitation to the present disclosure. Moreover, throughout the drawings, the same reference signs are used to denote the same components. In the drawings.

LIST OF REFERENCE SIGNS

Figure 1:
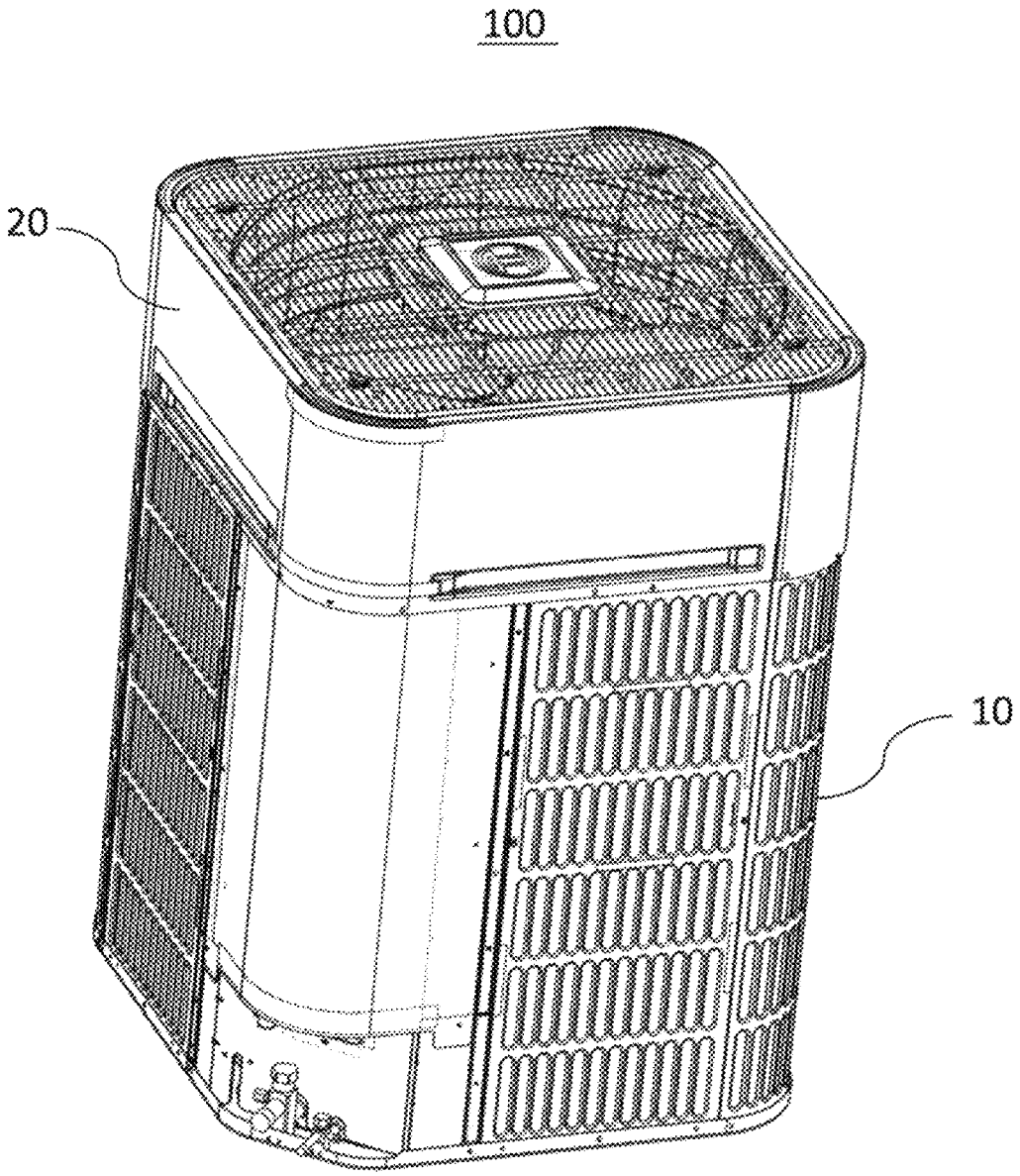
FIG. 1 shows a schematic structural view of an outdoor unit of an HVAC apparatus according to an embodiment of the present disclosure.

100: outdoor unit of HVAC apparatus;
10: cabinet;
20: top cover;
30: air guide cover;
31: air guide channel; 32: air inlet; 33: air outlet; 34: second flow-disturbance structure; 341: second air guide plane; 35: first flow-disturbance structure; 351: first air guide plane; 36: wiring hole;
40: fan;
50: drive member;
60: heat exchanger.

DETAILED DESCRIPTION

Hereinafter, exemplary embodiments of the present disclosure will be described in greater detail with reference to the accompanying drawings. Although the exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

It should be understood that the terms used herein are only for the purpose of describing specific exemplary embodiments, and are not intended to be limitative. Unless clearly indicated otherwise in the context, singular forms "a," "an," and "said" as used herein may also mean that plural forms are included. Terms "include," "comprise," "contain" and "have" are inclusive, and therefore indicate the existence of the stated features, steps, operations, elements and/or components, but do not exclude the existence or addition of one or more other features, steps, operations, elements, components, and/or combinations thereof. The method steps, processes, and operations described herein should not be interpreted as requiring them to be executed in the specific order described or illustrated, unless the order of execution is clearly indicated. It should also be understood that additional or alternative steps may be used.

Although terms "first," "second," "third" and the like may be used herein to describe multiple elements, components, regions, layers and/or sections, these elements, components, regions, layers and/or sections should not be limited by these terms. These terms may only be used to distinguish one element, component, region, layer or section from another region, layer or section. Unless clearly indicated in the context, terms such as "first," "second" and other numerical terms do not imply an order or sequence when they are used herein. Therefore, the first element, component, region, layer or section discussed below may be referred to as a second element, component, region, layer or section without departing from the teachings of the exemplary embodiments.

For ease of description, spatial relative terms may be used herein to describe the relationship of one element or feature relative to another element or feature as shown in the drawings. These relative terms are, for example, "inner," "outer," "inside," "outside," "below," "under," "above," "over," etc. These spatial relative terms are intended to include different orientations of the device in use or in operation in addition to the orientation depicted in the drawings. For example, if the device in the figures is turned over, then elements described as "below other elements or features" or "under other elements or features" will be oriented "above the other elements or features" or "over the other elements or features." Thus, the exemplary term "below" may include orientations of both above and below. The device can be otherwise oriented (rotated by 90 degrees or in other directions), and the spatial relationship descriptors used herein will be explained accordingly.

In this disclosure, the phrases "at least one of A, B, and C" and "at least one of A, B, or C" both mean only A, only B, only C, or any combination of A, B, and C.

As shown in FIGS. 1 to 6, according to an embodiment of the present disclosure, an air guide cover 30 used for an outdoor unit 100 of an HVAC apparatus is proposed. The air guide cover 30 includes an air outlet 33, an air guide channel 31, and an air inlet 32. The air guide channel 31 communicates the air inlet 32 with the air outlet 33, and a flow-disturbance structure is provided on at least one of an inner wall of the air outlet 33, an inner wall of the air guide channel 31, or an inner wall of the air inlet 32. The flow-disturbance structure includes but is not limited to at least one of a cutting plane part or a protrusion part.

It should be understood that in the embodiments of the present disclosure, the protrusion part refers to a structure formed on the inner wall of the air outlet 33, the inner wall of the air guide channel 31, or the inner wall of the air inlet 32. The protrusion part is arranged to protrude relative to the position where it is formed, and is arranged to protrude in a direction approaching an axis of the air guide channel 31.

In addition, in the embodiments of the present disclosure, the cutting plane part refers to a structure formed on the inner wall of the air outlet 33, the inner wall of the air guide channel 31, or the inner wall of the air inlet 32, that is, it is formed by removing materials from the inner wall of the air outlet 33, the inner wall of the air guide channel 31, or the inner wall of the air inlet 32, and the position after material removal has a planar structure.

Specifically, when the air guide cover 30 is used for the outdoor unit 100 of the HVAC apparatus, a fan 40 of the outdoor unit 100 of the HVAC apparatus is rotatably arranged in the air guide channel 31 of the air guide cover 30. When the fan 40 rotates, air enters the air guide channel 31 from the air inlet 32, and is discharged through the air outlet 33. The flowing airflow exchanges heat with the outdoor unit 100 of the HVAC apparatus.

When the fan 40 drives the airflow to pass through the air guide cover 30, due to the presence of the flow-disturbance structure provided on at least one of the inner wall of the air outlet 33, the inner wall of the air inlet 32 and the inner wall of the air guide channel 31, an interior of the air guide cover 30 has a structural change in its radial direction, so that when the fan 40 rotates, the frequency of regular interference of the driven airflow with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

It should be pointed out that in the embodiments of the present disclosure, the flow-disturbance structure can be arranged in various ways. For example, the flow-disturbance structure can be formed only on the inner wall of the air inlet 32; the flow-disturbance structure can also be formed only on the inner wall of the air outlet 33; the flow-disturbance structure can also be formed only on the inner wall of the air guide channel 31; the flow-disturbance structure can be formed on the inner wall of the air inlet 32 and the inner wall of the air outlet 33; the flow-disturbance structure can be formed on the inner wall of the air inlet 32 and the inner wall of the air guide channel 31; the flow-disturbance structure can be formed on the inner wall of the air outlet 33 and the inner wall of the air guide channel 31; and the flow-disturbance structure can be formed on the inner wall of the air inlet 32, the inner wall of the air guide channel 31, and the inner wall of the air outlet 33.

In addition, the structural form of the flow-disturbance structure can only be a protrusion part; it can also be only a cutting plane part, or a combination structure formed by a protrusion part and a cutting plane part.

In some embodiments of the present disclosure, as shown in FIGS. 2 to 5, the air guide channel 31 inside the air guide cover 30 communicates the air inlet 32 with the air outlet 33. The air guide channel 31 is configured as a cylindrical channel, and the air outlet 33 is configured as a first horn mouth. The first horn mouth is communicated with the air guide channel 31, and a first flow-disturbance structure 35 of the flow-disturbance structure is provided on an inner wall surface of the first horn mouth. The cylindrical air guide channel 31 has an axis, and there is a first angle al between the axis and an inclination direction of the inner wall of the first horn mouth. The first flow-disturbance structure 35 has a first air guide plane 351 facing the axis, and there is a second angle a between the axis and the first air guide plane 351, where a1>a≥0°.

It should be understood that the first horn mouth has a large end and a small end. The small end of the first horn mouth is communicated with the air guide channel 31, and the large end of the first horn mouth is used for the discharge of airflow.

Specifically, by configuring the air outlet 33 as the first horn mouth, when the airflow passes through the air outlet 33 and leaves the interior of the air guide channel 31, the first horn mouth diffuses the airflow, increasing the flow area of the airflow and thus improving the guiding ability of the air guide cover 30 for the airflow. When the air guide cover 30 is used for the outdoor unit 100 of the HVAC apparatus, it can effectively improve the heat exchange effect of the outdoor unit 100 of the HVAC apparatus. By providing the first flow-disturbance structure 35 at the position of the air outlet 33, during the process of the airflow passing through the air outlet 33 and leaving the air guide channel 31, the second angle a between the first air guide plane 351 and the axis of the air guide channel 31 and the first angle a1 between the inner wall of the first horn mouth and the air guide channel 31 are different, resulting in a structural change in the inner wall of the first horn mouth in the radial direction of the air guide channel 31, so that when the fan 40 rotates, the frequency of regular interference of the driven airflow with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

It should be pointed out that in the embodiments of the present disclosure, the first air guide plane 351 is used to guide the airflow to leave the air guide cover 30 through the air guide channel 31 and the air outlet 33.

In addition, the inner wall surface of the first horn mouth can be planar or curved. In the embodiments of the present disclosure, the inner wall surface of the first horn mouth is planar, and the connection position between the inner wall surface of the first horn mouth and the inner wall surface of the air guide channel 31 is smoothly transitioned, so that the airflow can pass through relatively smoothly, thereby effectively reducing the noise generated when the airflow passes through.

Figure 2:
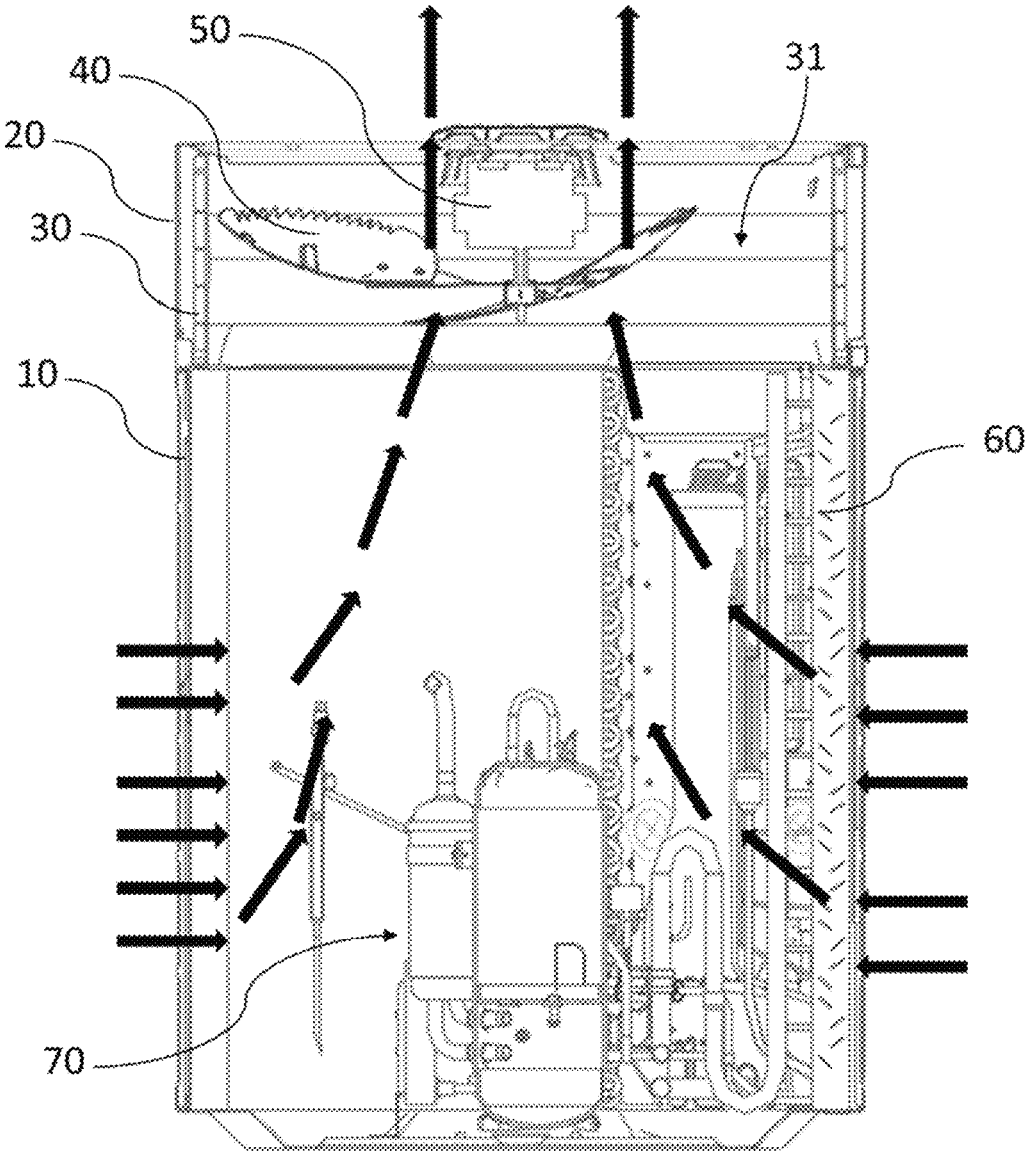
FIG. 2 is a sectional view of the outdoor unit of the HVAC apparatus shown in FIG. 1 (with black solid thick arrow lines in the figure indicating the direction of airflow)
Figure 3:
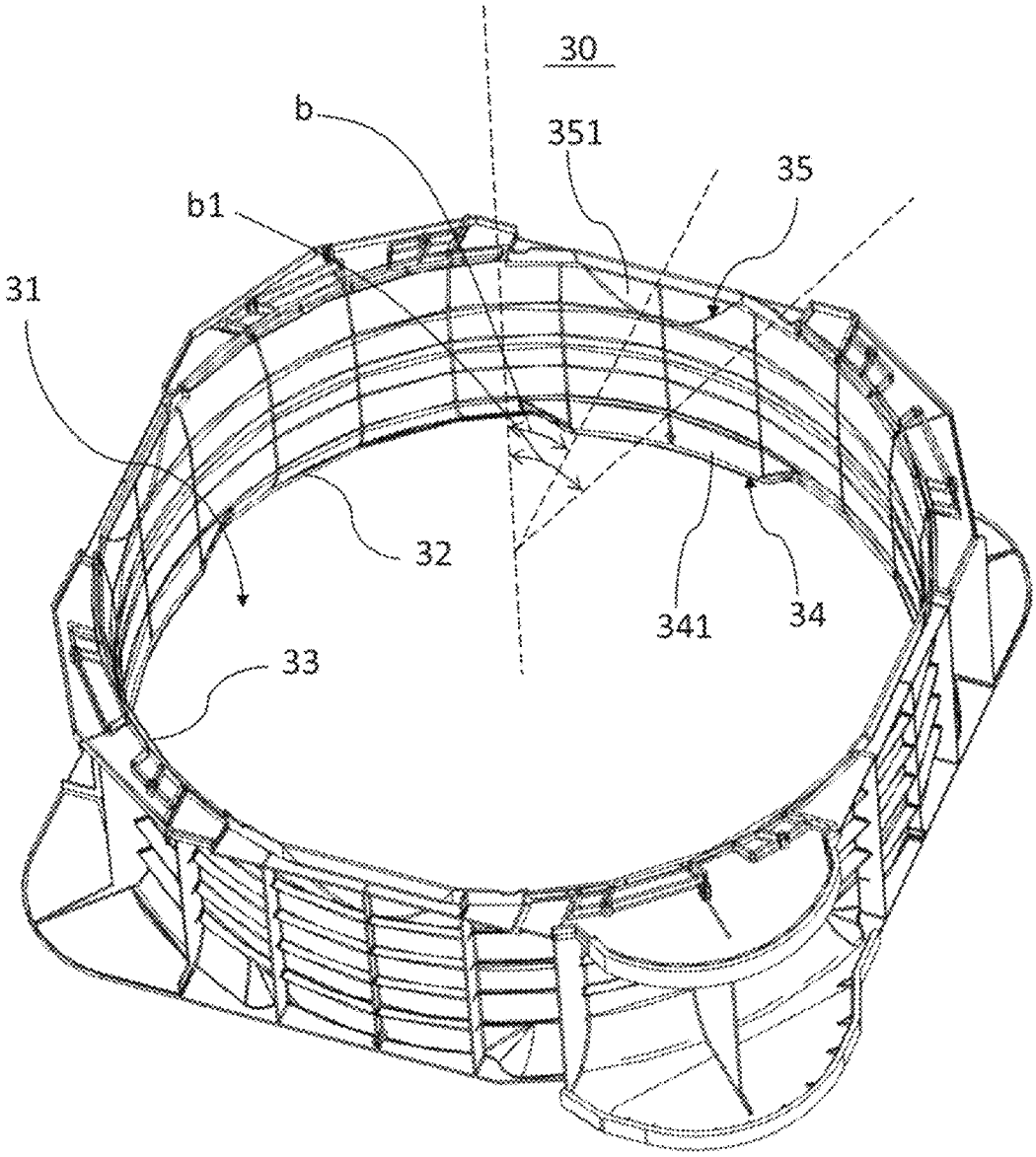
FIG. 3 is a schematic structural view of an air guide cover shown in FIG. 2 when viewed from a first angle.

In some embodiments of the present disclosure, as shown in FIG. 2, the first flow-disturbance structure 35 is provided on the inner wall surface of the air outlet 33 which is the first horn mouth, and the first flow-disturbance structure 35 has the first air guide plane 351. There is a second angle a between the first air guide plane 351 and the axis of the air guide channel 31 which is the cylindrical channel, and there is a first angle a1 between the inclination direction of the inner wall of the first horn mouth and the axis of the air guide channel 31, where a1>a≥0°, and 60°≥a1>0°.

Specifically, when a1 is equal to 0°, the air outlet 33 does not form the structure of the first horn mouth at this time. When the airflow passes through the air outlet 33, it cannot be diffused, and it is impossible to improve the ability of the air guide cover 30 to conduct the airflow by increasing the flow area of the airflow. When a1 is larger than 60°, the inclination angle of the first horn mouth formed by the air outlet 33 at this time is relatively large, and the diffusion ability of the first horn mouth to the airflow is reduced, which is not advantageous for enhancing the conducting ability of the air guide cover 30. In the embodiments of the present disclosure, the angle between the inner wall surface of the first horn mouth and the axial direction of the air guide channel 31 is controlled within a reasonable range by setting a1, thereby effectively improving the airflow conductivity.

It should be pointed out that in the embodiments of the present disclosure, the value of a1 can be 5°, 10°, 15°, 20°, 25°, 30°, 35°, 40°, 45°, 50°, 55° or 60°.

In addition, when a1 is selected as any value within the range of (0°, 60°], the second angle a between the first air guide plane 351 and the axis of the air guide channel 31 which is the cylindrical channel is smaller than a1 and larger than or equal to 0°. For example, when a1 is 10°, the value of a can be 0°, 1°, 2°, 3°, 4°, 5°, 6°, 7°, 8° or 9°.

In some embodiments of the present disclosure, the axis of the air guide channel 31 is arranged in parallel with the first air guide plane 351 of the first flow-disturbance structure 35, a distance between the axis of the air guide channel 31 and the first air guide plane 351 is x, and the radius of the air guide channel 31 is R, where 0≤x<R.

Specifically, the axis of the air guide channel 31 is arranged in parallel with the first air guide plane 351 of the first flow-disturbance structure 35. At this time, the value of the second angle a is 0°. Arranging the axis of the air guide channel 31 in parallel with the first air guide plane 351 of the first flow-disturbance structure 35 facilitates the processing of the first flow-disturbance structure 35 during the manufacturing process, thereby reducing the difficulty of processing and lowering the manufacturing cost.

At the same time, by setting the distance x between the axis of the air guide channel 31 and the first air guide plane 351, the first air guide plane 351 can have multiple arrangement positions, so that the air guide cover 30 can further meet the needs of use by adjusting the value of x.

Figure 5:
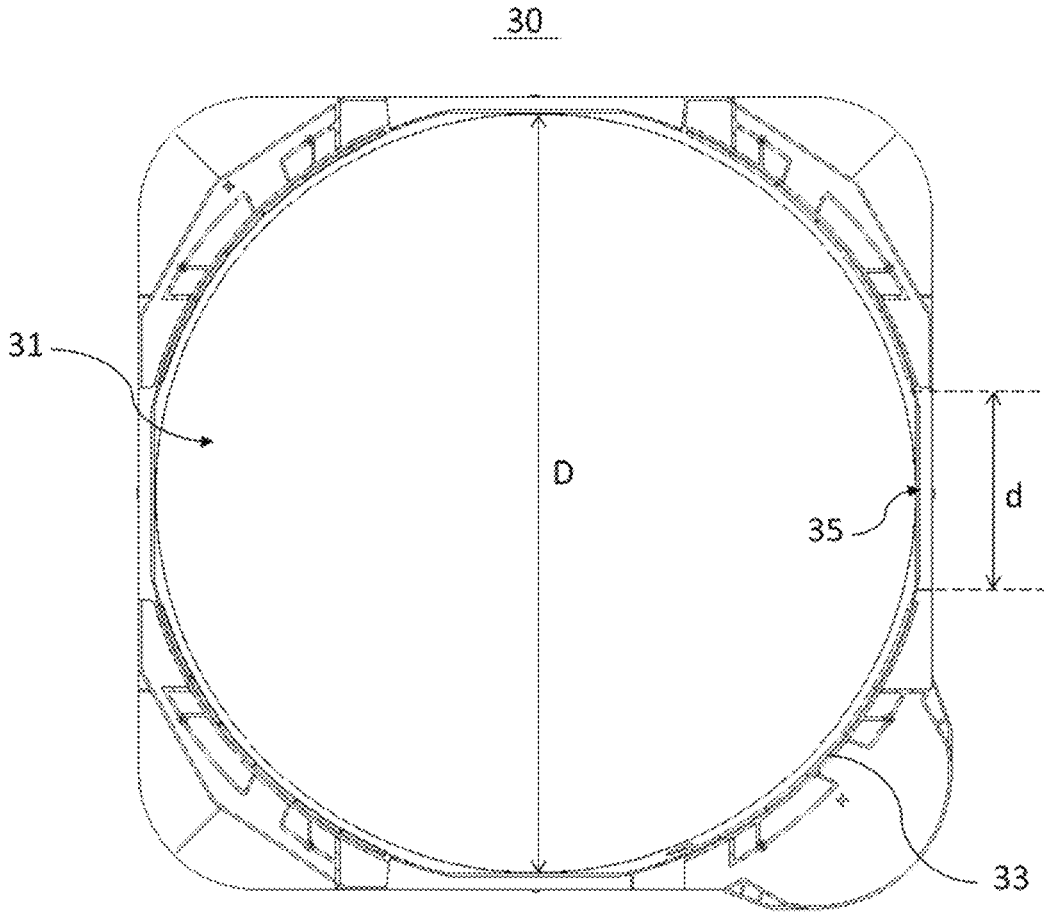
FIG. 5 is a schematic structural view of the air guide cover shown in FIG. 2 when viewed from a third angle.

In some embodiments of the present disclosure, as shown in FIG. 5, the air guide channel 31 is a cylindrical channel. In the radial direction of the cylindrical channel, the radial size of the second air guide plane 341 is defined as d, and at the same time, the diameter of the air guide channel 31 is defined as D (which is not zero), where 0.5D>d>0.

Specifically, when d is equal to 0, that is, when the first flow-disturbance structure 35 does not exist, it is impossible to use the first flow-disturbance structure 35 to increase the frequency of low-frequency noise generated by the air guide cover 30 during use; and when d is larger than or equal to 0.5D, the size of the first flow-disturbance structure 35 at this time is larger, and the interference effect on the airflow is more obvious, which will lead to a decrease in the flow velocity of the airflow, thereby affecting the performance of the air guide cover 30.

In the embodiments of the present application, by controlling d within a reasonable range of 0.5D>d>0, the adverse effect on the airflow velocity can be reduced while increasing the noise frequency during the use of the air guide cover 30.

It should be pointed out that in the embodiments of the present application, the value of d can be 0.1D, 0.15D, 0.2D, 0.25D, 0.3D, 0.35D, 0.4D, 0.45D or 0.5D.

In some embodiments of the present disclosure, the number of the first flow-disturbance structures 35 is defined as N, and the number of fan blades of the fan 40 of the outdoor unit 100 of the HVAC apparatus is defined as n, where N and n are both positive integers larger than or equal to 1, and 50n>N>0.2n.

Specifically, the number of the first flow-disturbance structures 35 is linked to the number of fan blades of the fan 40, so that the first flow-disturbance structures 35 can be more matched with the fan 40, thereby enabling the first flow-disturbance structures 35 to disturb the airflow during the rotation of the fan 40, effectively increasing the frequency of noise generated during the operation of the fan 40, further reducing the generation of low-frequency noise, and further improving the comfort of users during use.

It should be understood that when the value of 0.2n is smaller than 1, the value of N is 1; and when the value of 0.2n is larger than 1 and is a non-integer, the value of N is a positive integer that is larger than 0.2n and closest to 0.2.

In the embodiments of the present application, the number of the first flow-disturbance structures 35 may be positively correlated with the number of fan blades of the fan 40, that is, as the number of fan blades of the fan 40 increases, the number of the first flow-disturbance structures 35 also increases. Conversely, as the number of fan blades of the fan 40 decreases, the number of the first flow-disturbance structures 35 also decreases.

It should be pointed out that in the embodiments of the present disclosure, the value of the number N of the first flow-disturbance structures 35 can be n, 1.1n, 1.3n, 1.6n, 1.9n, 2n, 6n, 8n, 10n, 15n, 20n, 25n, 30n, 35n, 40n, 45n, 46n, 47n, 48n or 49n. For example, if the number of fan blades of the fan 40 is n=3, then the number of the first flow-disturbance structures 35 is N=4.

In some embodiments of the present disclosure, as shown in FIGS. 2 to 5, multiple (two or more) first flow-disturbance structures 35 are provided on the air outlet 33, and all of the first flow-disturbance structures 35 are arranged at intervals in a circumferential direction of the air guide channel 31. By providing multiple first flow-disturbance structures 35, the disturbing effect on the airflow is increased, so that when the fan 40 rotates, the frequency of regular interference of the driven airflow with surrounding objects is further increased, the frequency of the low-frequency noise accumulated by the rotation of the fan 40 is further increased, and the spikes of the rotating noise in the same frequency band are further reduced, thereby further reducing the low-frequency noise during use and further improving the user experience.

It should be pointed out that in the embodiments of the present disclosure, the number of the first flow-disturbance structures 35 can be 2, 3, 4, 5, 6, 7, 8, 9 or 10.

In addition, multiple first flow-disturbance structures 35 can all be located on the same flow cross section, or partially on the same flow cross section, or they can be located on different flow cross sections. In the embodiments of the present disclosure, multiple first flow-disturbance structures 35 can all be located on the same flow cross section, and the multiple first flow-disturbance structures 35 can be arranged at equal intervals or unequal intervals in the circumferential direction of the air guide channel 31.

In some embodiments of the present disclosure, the first flow-disturbance structure 35 is a cutting plane part formed on the inner wall surface of the first horn mouth, that is, the cutting plane part is formed by removing materials from the inner wall surface of the first horn mouth. The structure of the cutting plane part is simple, easy to machine and manufacture, and can effectively reduce manufacturing cost.

In addition, when forming the cutting plane part, the cut surface formed after material removal is a plane, which is the first air guide plane 351.

In some embodiments of the present disclosure, as shown in FIGS. 2, 3, 4, and 6, the air guide channel 31 inside the air guide cover 30 communicates the air inlet 32 with the air outlet 33. The air guide channel 31 is configured as a cylindrical channel, the air inlet 32 is configured as a second horn mouth, and the second horn mouth is communicated with the air guide channel 31. The second flow-disturbance structure 34 of the flow-disturbance structure is provided on the inner wall surface of the second horn mouth. The cylindrical air guide channel 31 has an axis, and there is a third angle b1 between the axis and the inclination direction of the inner wall of the second horn mouth. The second flow-disturbance structure 34 has a second air guide plane 341 facing the axis, and there is a fourth angle b between the axis and the second air guide plane 341, where b1>b≥0°.

It should be understood that the second horn mouth has a large end and a small end. The small end of the second horn mouth is communicated with the air guide channel 31, and the large end of the second horn mouth is used for the entry of airflow.

Specifically, by configuring the air inlet 32 as the second horn mouth, when the airflow passes through the air outlet 33 and leaves the interior of the air guide channel 31, the second horn mouth collects the airflow, compressing the volume of the airflow during the flow, thereby increasing the velocity of the airflow entering the air guide channel 31. When the air guide cover 30 is used for the outdoor unit 100 of the HVAC apparatus, it can effectively improve the heat exchange effect of the outdoor unit 100 of the HVAC apparatus. By providing the second flow-disturbance structure 34 at the position of the air inlet 32, during the process of airflow entering the air guide channel 31 through the air inlet 32, the second angle b between the second air guide plane 341 and the axis of the air guide channel 31 and the second angle b1 between the inner wall of the second horn mouth and the air guide channel 31 are different, resulting in a structural change in the inner wall of the second horn mouth in the radial direction of the air guide channel 31, so that when the fan 40 rotates, the frequency of regular interference of the driven airflow with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

It should be pointed out that in the embodiments of the present disclosure, the second air guide plane 341 is used to guide the airflow to enter the air guide channel 31 from the air inlet 32.

In addition, the inner wall surface of the second horn mouth can be planar or curved. In the embodiments of the present disclosure, the inner wall surface of the second horn mouth is planar, and the connection position between the inner wall surface of the second horn mouth and the inner wall surface of the air guide channel 31 is smoothly transitioned, so that the airflow can pass through relatively smoothly, thereby effectively reducing the noise generated when the airflow passes through.

Figure 4:
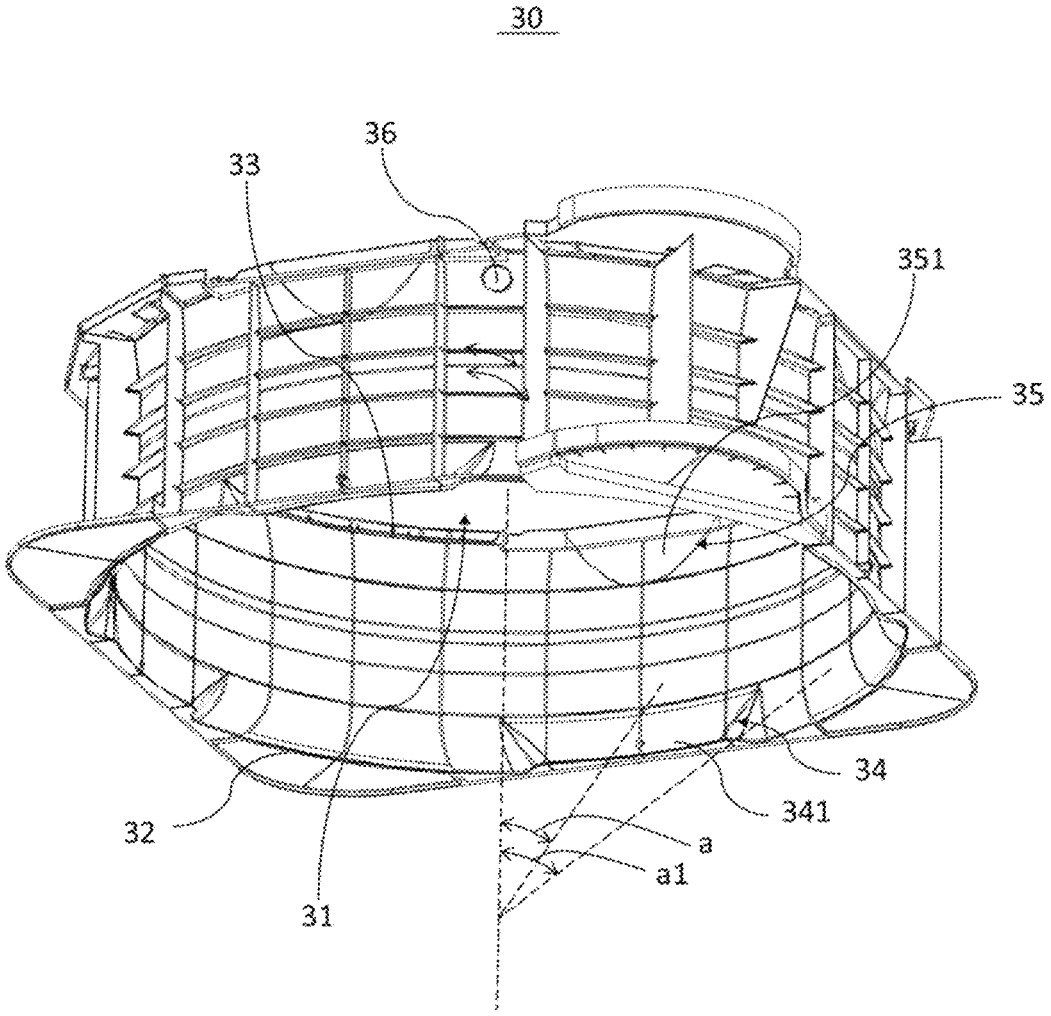
FIG. 4 is a schematic structural view of the air guide cover shown in FIG. 2 when viewed from a second angle.

In some embodiments of the present disclosure, as shown in FIG. 4, the second flow-disturbance structure 34 is provided on the inner wall surface of the air inlet 32 which is the second horn mouth, and the second flow-disturbance structure 34 has the second air guide plane 341. There is a fourth angle b between the second air guide plane 341 and the axis of the air guide channel 31 which is the cylindrical channel, and there is a third angle b1 between the inclination direction of the inner wall of the second horn mouth and the axis of the air guide channel 31, where b1>b≥0°, and 60°≥b1>0°.

Specifically, when b1 is equal to 0°, the air inlet 32 does not form the structure of the second horn mouth at this time. When the airflow passes through the air outlet 33, it cannot be collected, which is not advantageous for increasing the velocity of airflow. When b1 is larger than 60°, the inclination angle of the first horn mouth formed by the air outlet 33 at this time is relatively large, resulting in a larger radial size of the air guide cover 30, which is not advantageous for layout and installation. In the embodiments of the present disclosure, the angle between the inner wall surface of the second horn mouth and the axial direction of the air guide channel 31 is controlled within a reasonable range by setting b1, thereby effectively improving the airflow conductivity.

It should be pointed out that in the embodiments of the present disclosure, the value of b1 can be 5°, 10°, 15°, 20°, 25°, 30°, 35°, 40°, 45°, 50°, 55° or 60°.

In addition, when b1 is selected as any value within the range of (0°, 60°], the fourth angle b between the second air guide plane 341 and the axis of the air guide channel 31 which is the cylindrical channel is smaller than b1 and larger than or equal to 0°. For example, when b1 is 10°, the value of b can be 0°, 1°, 2°, 3°, 4°, 5°, 6°, 7°, 8° or 9°.

In some embodiments of the present disclosure, the axis of the air guide channel 31 is arranged in parallel with the second air guide plane 341 of the second flow-disturbance structure 34, a distance between the axis of the air guide channel 31 and the second air guide plane 341 is y, and the radius of the air guide channel 31 is R, where $0 \leq y < R$.

Specifically, the axis of the air guide channel 31 is arranged in parallel with the second air guide plane 341 of the second flow-disturbance structure 34. At this time, the value of the fourth angle b is 0°. Arranging the axis of the air guide channel 31 in parallel with the second air guide plane 341 of the second flow-disturbance structure 34 facilitates the processing of the second flow-disturbance structure 34 during the manufacturing process, thereby reducing the difficulty of processing and lowering the manufacturing cost.

At the same time, by setting the distance y between the axis of the air guide channel 31 and the second air guide plane 341, the second air guide plane 341 can have multiple arrangement positions, so that the air guide cover 30 can further meet the needs of use by adjusting the value of y.

Figure 6:
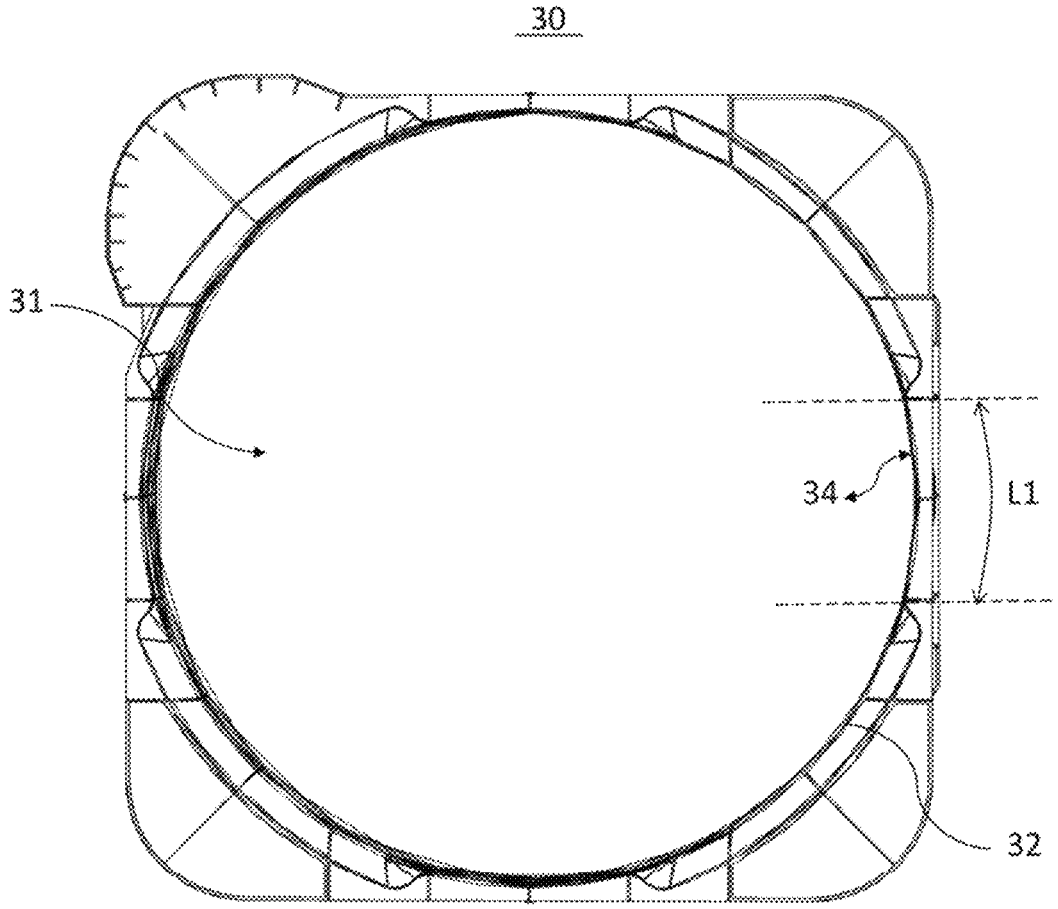
FIG. 6 is a schematic structural view of the air guide cover shown in FIG. 2 when viewed from a fourth angle.

In some embodiments of the present disclosure, as shown in FIG. 6, the air guide channel 31 is a cylindrical channel. In the circumferential direction of the cylindrical channel, the circumferential size of the second air guide plane 341 is defined as L, and the perimeter of the air guide channel 31 is defined as L1, where $L1 > L > 0.1L1$.

Specifically, when L is smaller than 0.1 L, that is, when the structure of the second flow-disturbance structure 34 is relatively small, the effect of increasing the frequency of the low-frequency noise generated by the air guide cover 30 during use by the second flow-disturbance structure 34 is poor.

In the embodiments of the present application, by controlling L within a reasonable range of $L1 > L > 0.1L1$, the noise frequency is effectively increased during the use of the air guide cover 30.

It should be pointed out that in the embodiments of the present application, the value of L can be 0.2L1, 0.3L1, 0.4L1, 0.5L1, 0.6L1, 0.7L1, 0.8L1 or 0.9L1.

In some embodiments of the present disclosure, the number of the second flow-disturbance structures 34 is defined as M, and the number of fan blades of the fan 40 of the outdoor unit 100 of the HVAC apparatus is defined as n, where M and n are both positive integers larger than or equal to 1, and $50n > M > 0.2n$.

Specifically, the number of the second flow-disturbance structures 34 is linked to the number of fan blades of the fan 40, so that the second flow-disturbance structures 34 can be more matched with the fan 40, thereby enabling the second flow-disturbance structures 34 to disturb the airflow during the rotation of the fan 40, effectively increasing the frequency of noise generated during the operation of the fan 40, further reducing the generation of low-frequency noise, and further improving the comfort of users during use.

It should be understood that when the value of 0.2n is smaller than 1, the value of M is 1; and when the value of 0.2n is larger than 1 and is a non-integer, the value of M is a positive integer that is larger than 0.2n and closest to 0.2.

In the embodiments of the present application, the number of the second flow-disturbance structures 34 may be positively correlated with the number of fan blades of the fan 40, that is, as the number of fan blades of the fan 40 increases, the number of the second flow-disturbance structures 34 also increases. Conversely, as the number of fan blades of the fan 40 decreases, the number of the second flow-disturbance structures 34 also decreases.

It should be pointed out that in the embodiments of the present disclosure, the value of the number M of the second flow-disturbance structures 34 can be n, 1. 1n, 1.3n, 1.6n, 1.9n, 2n, 6n, 8n, 10n, 15n, 20n, 25n, 30n, 35n, 40n, 45n, 46n, 47n, 48n or 49n. For example, if the number of fan blades of the fan 40 is n=3, then the number of the second flow-disturbance structures 34 is M=4.

In some embodiments of the present disclosure, as shown in FIGS. 2, 3, 4 and 6, multiple (two or more) second flow-disturbance structures 34 are provided on the air inlet 32, and all of the second flow-disturbance structures 34 are arranged at intervals in a circumferential direction of the air guide channel 31. By providing multiple second flow-disturbance structures 34, the disturbing effect on the airflow is increased, so that when the fan 40 rotates, the frequency of regular interference of the driven airflow with surrounding objects is further increased, the frequency of the low-frequency noise accumulated by the rotation of the fan 40 is further increased, and the spikes of the rotating noise in the same frequency band are further reduced, thereby further reducing the low-frequency noise during use and further improving the user experience.

It should be pointed out that in the embodiments of the present disclosure, the number of the second flow-disturbance structures 34 can be 2, 3, 4, 5, 6, 7, 8, 9 or 10.

In addition, multiple second flow-disturbance structures 34 can all be located on the same flow cross section, or partially on the same flow cross section, or they can be located on different flow cross sections. In the embodiments of the present disclosure, multiple second flow-disturbance structures 34 can all be located on the same flow cross section, and the multiple second flow-disturbance structures 34 can be arranged at equal intervals or unequal intervals in the circumferential direction of the air guide channel 31.

In some embodiments of the present disclosure, the second flow-disturbance structure 34 is a protrusion part formed on the inner wall surface of the second horn mouth, that is, a protrusion part is formed by forming a protruding structure on the inner wall surface of the second horn mouth. The structure of the protrusion part is simple, easy to machine and manufacture, and can effectively reduce manufacturing cost.

In addition, the surface of the protrusion part that faces the axis of the air guide channel 31 is a second flow guide surface, and the connection surface between the protrusion part and the inner wall of the second horn mouth is triangular, trapezoidal, or rectangular.

In some embodiments of the present disclosure, as shown in FIGS. 2 to 6, the flow-disturbance structure includes the first flow-disturbance structure 35 and the second flow-disturbance structure 34. The air guide cover 30 includes the air outlet 33, the air guide channel 31, and the air inlet 32. The air guide channel 31 communicates the air inlet 32 with the air outlet 33. The air outlet 33 is the first horn mouth and is provided with four first flow-disturbance structures 35. The four first flow-disturbance structures 35 are arranged at equal intervals in the circumferential direction of the air guide channel 31. The first flow-disturbance structure 35 is a cutting plane part formed on the inner wall surface of the first horn mouth, and the cutting plane part has the first air guide plane 351. The angle between the inner wall surface of the first horn mouth and the inner wall surface of the air guide channel 31 is 10°, and the angle between the first air guide plane 351 and the axis of the air guide channel 31 is 0°. In the radial direction of the air guide channel 31, the radial size of the first air guide plane 351 is larger than 0 and smaller than the radius of the air guide channel 31. The air inlet 32 is the second horn mouth and is provided with four second flow-disturbance structures 34. The four second flow-disturbance structures 34 are arranged at equal intervals in the circumferential direction of the air guide channel 31. The second flow-disturbance structure 34 is a protrusion part formed on the inner wall surface of the second horn mouth, and the protrusion part has the second air guide plane 341. The angle between the inner wall surface of the second horn mouth and the inner wall surface of the air guide channel 31 is 30°, and the angle between the second air guide plane 341 and the axis of the air guide channel 31 is 0°. In the circumferential direction of the air guide channel 31, the circumferential size of the second air guide plane 341 is larger than 0.1 times the perimeter of the air guide channel 31, and smaller than the perimeter of the air guide channel 31. In a case where the air guide cover 30 is used for the outdoor unit 100 of the HVAC apparatus, when the airflow is driven by the fan 40 to pass through the air guide cover 30, due to the presence of the flow-disturbance structure provided on at least one of the inner wall of the air outlet 33, the inner wall of the air inlet 32, or the inner wall of the air guide channel 31, the interior of the air guide cover 30 has a structural change in its radial direction, so that when the fan 40 rotates, the frequency of regular interference of the driven airflow with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

As shown in FIGS. 1 to 6, the present disclosure also proposes an outdoor unit 100 of an HVAC apparatus. The outdoor unit 100 of the HVAC apparatus includes a cabinet 10, a heat exchanger 60, a fan 40, and the air guide cover 30 as described above. The heat exchanger 60 is arranged inside the cabinet 10, the air guide cover 30 is installed on the cabinet 10 and located at the top of the heat exchanger 60, and the fan 40 is rotatably arranged in the air guide channel 31 of the air guide cover 30.

Specifically, the fan 40 is rotatably arranged in the air guide channel 31 of the air guide cover 30. When the fan 40 rotates, air enters the air guide channel 31 from the air inlet 32 and is discharged through the air outlet 33, and heat exchange occurs between the flowing airflow and the outdoor unit 100 of the HVAC apparatus. When the airflow is driven by the fan 40 to pass through the air guide cover 30, due to the presence of the flow-disturbance structure provided on at least one of the inner wall of the air outlet 33, the inner wall of the air inlet 32 and the inner wall of the air guide channel 31, the interior of the air guide cover 30 has a structural change in its radial direction, so that the frequency of regular interference of the rotating fan 40 with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

Further, the outdoor unit 100 of the HVAC apparatus further includes a top cover 20 and an electric control box assembly. The heat exchanger 60 is installed in the interior of the cabinet 10, and at this time, the top cover 20 is connected to the top of the cabinet 10 and located above the heat exchanger 60. The fan 40 is installed inside the top cover 20 and located above the heat exchanger 60, and at this time, the fan 40 is located outside the heat exchanger 60. The electric control box assembly is installed on the cabinet 10 and has a heat dissipation air duct. One end of the heat dissipation air duct is communicated with the outside, and the other end of the heat dissipation air duct is communicated with the interior of the cabinet 10. The fan 40 rotates in the air guide channel 31 of the air guide cover 30. The rotation of the fan 40 drives the airflow, allowing the external airflow to enter the interior of the cabinet 10 through the heat dissipation air duct, while also enabling the airflow inside the cabinet 10 to be discharged to the outside through the top cover 20.

In the related art, the heat exchanger 60 is located radially outward of the fan 40 in a surrounding manner, and at this time, the diameter of the fan 40 is limited by the structural shape of the heat exchanger 60. At this time, the fan 40 has limited ability to drive the airflow.

In the embodiments of the present disclosure, the fan 40 is arranged above the heat exchanger 60, that is, the fan 40 is arranged outside the heat exchanger 60, so that the size of the fan 40 is not limited by the structural size of the heat exchanger 60. By increasing the size of the fan 40, the ability of the fan 40 to drive the airflow is improved, thereby reducing the problem of airflow stagnation region in the outdoor unit 100 of the HVAC apparatus, and effectively improving the heat exchange effect of the outdoor unit 100 of the HVAC apparatus. At the same time, the interior of the cabinet 10 can be communicated with the outside through the heat dissipation air duct of the electric control box assembly. When driven by the fan 40, the airflow can enter the heat dissipation air duct to achieve heat dissipation of the electric control box assembly, further reducing the problem of airflow stagnation region in the outdoor unit 100 of the HVAC apparatus.

In the embodiments of the present disclosure, the electric control box assembly is used to control the outdoor unit 100 of the HVAC apparatus accordingly, including but not limited to powering on, powering off, and switching of working modes. The electric control box assembly generates heat during operation. If effective heat dissipation cannot be achieved for the electric control box assembly, it will malfunction due to high temperature, which will thus affect the operation of the outdoor unit 100 of the HVAC apparatus.

In addition, the fan 40 can be a metal part or a non-metal part. In the embodiments of the present disclosure, the fan 40 is a non-metal part, such as a plastic part or a carbon fiber part, which can be processed and manufactured by integral molding to improve the processing efficiency.

It should be pointed out that arranging the fan 40 in the air guide channel 31 of the air guide cover 30 enables the fan 40 to rotate in a relatively small space, thereby increasing the negative pressure formed during the rotation of the fan 40 under the same rotational speed of the fan 40, and further improving the ability to drive the airflow and increasing the velocity of the airflow.

In addition, the air guide cover 30 is arranged to wrap the fan 40, which can reduce the noise transmitted outward during the rotation of the fan 40, so that the noise generated during the operation of the outdoor unit 100 of the HVAC apparatus can be effectively reduced.

In the present disclosure, the outdoor unit 100 of the HVAC apparatus further includes a compressor assembly, which is arranged inside the cabinet 10. The heat exchanger 60 is arranged in the circumferential direction of the compressor assembly in a surrounding manner, and the electric control box assembly is electrically connected to the compressor assembly to control the operation of the compressor assembly.

The top cover 20 is provided with a top surface and a first communication port respectively, with the top surface facing away from the first communication port. The air inlet 32 of the air guide cover 30 is communicated with the first communication port, and the air outlet 33 is communicated with the outside through the top surface of the top cover 20. The top of the cabinet 10 of the outdoor unit 100 of the HVAC apparatus is fitted with the first communication port through insertion. The insertion fitting has a simple structure and can effectively optimize the structure, resulting in an effective reduction in the manufacturing cost. In addition, the insertion fitting facilitates assembly, which can effectively improve production efficiency and effectively lower production cost.

Further, the top cover 20 is provided with a second communication port, which is installed with a mesh cover and obstructed by the mesh cover. By providing the mesh cover at the second communication port, obstruction of the second communication port can be achieved on the basis of performing airflow exchange between the second communication port and the outside, thereby reducing the situation where external foreign objects fall into the interior of the body of the top cover 20 and the interior of the cabinet 10 through the second communication port.

It should be pointed out that the mesh cover is connected and fixed to the top cover 20, and the methods of connection and fixation include but are not limited to screw connection, snap-fit connection, buckle connection, riveting, bonding, welding, etc.

In addition, the mesh cover can be a metal part and can be processed through welding or casting during processing; the mesh cover can also be a non-metal part, such as a plastic part, which can be molded through one-time injection molding during processing.

In addition, the mesh cover has mesh holes with shapes including but not limited to circular, square, pentagonal, hexagonal, triangular, elliptical and diamond shapes, etc.

Further, the outdoor unit 100 of the HVAC apparatus further includes a drive member 50. The mesh cover has a side facing the second communication port, and the drive member 50 is installed and fixed on this side. The fan 40 is connected to a driving shaft of the drive member 50 and are rotatably arranged in the air guide channel 31 of the air guide cover 30.

Specifically, when the outdoor unit 100 of the HVAC apparatus is in operation, the drive member 50 rotates and drives the fan blades to rotate. During the rotation of the fan blades, the airflow flows from the first communication port to the second communication port, or from the second communication port to the first communication port. The fan 40 and the drive member 50 are used to drive the airflow, thereby improving the heat exchange efficiency of the outdoor unit 100 of the HVAC apparatus.

Further, a wiring hole 36 is provided on the air guide cover 30 for connection wires of the drive member 50 to pass through. By providing the wiring hole 36, it is easy to lead out the connection wires of the drive member 50, which increases the convenience of assembly and effectively improves the efficiency of assembly.

It should be pointed out that the wiring hole 36 includes but is not limited to a circular hole, a square hole, a diamond hole, a triangular hole, an elliptical hole, a pentagonal hole, or a hexagonal hole, etc.

The wiring hole 36 is provided on the side wall of the air guide cover 30 and is located near the drive member 50 to reduce the length of the connection wires in the air guide channel 31 of the air guide cover 30 and reduce the influence of the connection wires on the air guide channel 31.

Further, the mesh cover is installed in a groove at the top of the top cover 20, and the installation position of the mesh cover is limited by the groove, thereby achieving the limitation of the installation position of the fan 40 and reducing the noise generated by vibration and other reasons during the operation of the fan 40.

It should be understood that in the present disclosure, the fan 40 and the drive member 50 form an axial flow blower structure, that is, the entry and discharge of airflow in the axial direction of the fan 40 is achieved. In addition, in the present disclosure, under the driving of the fan 40 and the drive member 50, the airflow flows from one side of the first communication port to one side of the second communication port.

It should be pointed out that in the present disclosure, the connection method between the drive member 50 and the mesh cover includes but is not limited to screw connection, snap-fit connection, bonding, welding, riveting, etc. At the same time, the fan 40, the first connection port, and the second connection port are coaxially arranged.

In addition, the drive member 50 includes but is not limited to an electric motor or a starter motor.

The present disclosure also proposes an HVAC apparatus, which includes the outdoor unit 100 of an HVAC apparatus as described above.

In the HVAC apparatus according to the present disclosure, the fan 40 of the outdoor unit 100 of the HVAC apparatus are rotatably arranged in the air guide channel 31 of the air guide cover 30. When the fan 40 rotates, air enters the air guide channel 31 from the air inlet 32 and is discharged through the air outlet 33, and heat exchange occurs between the flowing airflow and the outdoor unit 100 of the HVAC apparatus. When the airflow is driven by the fan 40 to pass through the air guide cover 30, due to the presence of the flow-disturbance structure provided on at least one of the inner wall of the air outlet 33, the inner wall of the air inlet 32 and the inner wall of the air guide channel 31, the interior of the air guide cover 30 has a structural change in its radial direction, so that the frequency of regular interference of the rotating fan 40 with surrounding objects is increased, the frequency of the low-frequency noise accumulated by the rotation of the fan 40 is increased, and the spikes of the rotating noise in the same frequency band are reduced, thereby reducing the low-frequency noise during use and effectively improving the user experience.

In some embodiments of the present disclosure, the above HVAC apparatus is an air conditioner (in other embodiments of the present disclosure, the HVAC apparatus includes but is not limited to a multi-split air conditioner, a heat pump, a water heater, a swimming pool machine, etc.). For the structures of other parts of the air conditioner, reference may be made to the related art, and a detailed description is omitted in the present application.

Described above are only some specific embodiments of the present disclosure, but the scope of protection of the present disclosure is not limited to this. Any changes or replacements that can be easily conceived by those skilled in the art within the technical scope disclosed by the present disclosure should be covered within the scope of protection of the present disclosure. Therefore, the scope of protection of the present disclosure should be accorded with the scope of protection of the claims.

The invention claimed is:

1. An air guide cover comprising:

an air outlet;

an air guide channel configured to house a fan of an outdoor unit of an HVAC apparatus; and an air inlet communicated with the air outlet through the air guide channel;

wherein:

at least one of an inner wall of the air inlet, an inner wall of the air outlet, or an inner wall of the air guide channel is provided with a flow-disturbance structure;

the flow-disturbance structure includes at least one of a protrusion part or a cutting plane part;

the air guide channel includes a cylindrical channel, and the air outlet includes a horn mouth;

an inclination direction of an inner wall of the horn mouth is set at a first angle with an axis of the air guide channel, the first angle is smaller than or equal to 60°;

the flow-disturbance structure is arranged on the inner wall of the horn mouth;

the flow-disturbance structure has an air guide plane arranged facing the axis of the air guide channel and set at a second angle with the axis of the air guide channel; and the second angle is smaller than the first angle and larger than or equal to 0.

2. The air guide cover according to claim 1, wherein:

the air guide plane is arranged in parallel with the axis of the air guide channel, a distance between the air guide plane and the axis of the air guide channel is smaller than or equal to a radius of the air guide channel and greater than 0; and/or in a radial direction of the air guide channel, the air guide plane has a radial size smaller than a half of a diameter of the air guide channel and greater than 0.

3. The air guide cover according to claim 1, wherein:

the flow-disturbance structure is one of N flow-disturbance structures arranged on the inner wall of the horn mouth, N being a positive integer larger than or equal to 1;

the fan includes n fan blades, n being a positive integer larger than or equal to 1; and 1 $0.2n<N<50n$.

4. The air guide cover according to claim 3, wherein:

N is greater than 1, and the N flow-disturbance structures are arranged at intervals in a circumferential direction of the air guide channel; and/or the flow-disturbance structures are cutting plane parts formed on an inner wall surface of the horn mouth.

5. The air guide cover according to claim 1, wherein:

the horn mouth is a first horn mouth, the flow-disturbance structure is a first flow-disturbance structure;

the inner wall of the air guide channel is further provided with a second flow-disturbance structure;

the air inlet includes a second horn mouth;

an inclination direction of an inner wall of the second horn mouth is set at a third angle with the axis of the air guide channel; and the second flow-disturbance structure is arranged on the inner wall of the second horn mouth.

6. The air guide cover according to claim 5, wherein:

the air guide plane is a first air guide plane;

the second flow-disturbance structure has a second air guide plane arranged facing the axis of the air guide channel and set at a fourth angle with the axis of the air guide channel; and the fourth angle is smaller than the third angle and larger than or equal to 0°.

7. The air guide cover according to claim 6, wherein:

the third angle is smaller than or equal to 60°; and/or the second air guide plane is arranged in parallel with the axis of the air guide channel, a distance between the second air guide plane and the axis of the air guide channel is smaller than or equal to the radius of the air guide channel and greater than or equal to 0; and/or in a circumferential direction of the air guide channel, the second air guide plane has a circumferential size smaller than a perimeter of the air guide channel and greater than 0.1 times the perimeter of the air guide channel.

8. The air guide cover according to claim 5, wherein:

the second flow-disturbance structure is one of M second flow-disturbance structures arranged on the inner wall of the second horn mouth, M being a positive integer larger than or equal to 1;

the fan includes n fan blades, n being a positive integer larger than or equal to 1; and $0.2n<M<50n$.

9. The air guide cover according to claim 8, wherein:

M is greater than 1, and the M second flow-disturbance structures are arranged at intervals in a circumferential direction of the air guide channel; and/or the second flow-disturbance structures are protrusion parts, and connection surfaces between the protrusion parts and the inner wall of the second horn mouth are rectangular, trapezoidal, or triangular.

10. The air guide cover according to claim 1, wherein:

the flow-disturbance structure is one of a plurality of flow-disturbance structures including four first flow-disturbance structures and four second flow-disturbance structures;

the horn mouth is a first horn mouth, the four first flow-disturbance structures are provided at the first horn mouth and arranged at equal intervals in a circumferential direction of the air guide channel;

each of the four first flow-disturbance structures is a cutting plane part formed on the inner wall surface of the first horn mouth, and the cutting plane part has a first air guide plane;

an angle between the inner wall surface of the first horn mouth and the inner wall surface of the air guide channel is 10°, and the second angle between the first air guide plane and the axis of the air guide channel is 0°;

in the radial direction of the air guide channel, the radial size of the first air guide plane is larger than 0 and smaller than the radius of the air guide channel;

the air inlet includes a second horn mouth, the four second flow-disturbance structures are provided at the second horn mouth and arranged at equal intervals in the circumferential direction of the air guide channel;

each of the four second flow-disturbance structures is a protrusion part formed on an inner wall surface of the second horn mouth, and the protrusion part has a second air guide plane;

an angle between the inner wall surface of the second horn mouth and the inner wall surface of the air guide channel is 30°, and an angle between the second air guide plane and the axis of the air guide channel is 0°;

in the circumferential direction of the air guide channel, a circumferential size of the second air guide plane is larger than 0.1 times a perimeter of the air guide channel and smaller than the perimeter of the air guide channel.

11. An HVAC apparatus comprising:

an outdoor unit including:

a cabinet;

a heat exchanger, arranged inside the cabinet;

the air guide cover according to claim 1, installed on the cabinet and located at a top of the heat exchanger; and a fan, rotatably arranged in the air guide channel of the air guide cover.

12. An outdoor unit of an HVAC apparatus comprising:

a cabinet;

a heat exchanger, arranged inside the cabinet;

an air guide cover installed on the cabinet and located at a top of the heat exchanger, the air guide cover including:

an air outlet;

an air guide channel including a cylindrical channel; and an air inlet communicated with the air outlet through the air guide channel, wherein the air inlet includes a horn mouth, and an inclination direction of an inner wall of the horn mouth is set at an angle with an axis of the air guide channel;

wherein:

at least one of an inner wall of the air inlet, an inner wall of the air outlet, or an inner wall of the air guide channel is provided with a flow-disturbance structure;

the flow-disturbance structure includes at least one of a protrusion part or a cutting plane part; and the flow-disturbance structure is arranged on the inner wall of the horn mouth; and a fan, rotatably arranged in the air guide channel of the air guide cover.

13. The outdoor unit according to claim 12, wherein:

the horn mouth is a first horn mouth, the angle is a first angle, and the flow-disturbance structure is a first flow-disturbance structure;

the inner wall of the air guide channel is further provided with a second flow-disturbance structure, and the air outlet includes a second horn mouth;

an inclination direction of an inner wall of the second horn mouth is set at a second angle with the axis of the air guide channel; and the second flow-disturbance structure is arranged on the inner wall of the second horn mouth.

14. The outdoor unit according to claim 13, wherein:

the second flow-disturbance structure has an air guide plane arranged facing the axis of the air guide channel and set at a third angle with the axis of the air guide channel; and the third angle is smaller than the second angle and larger than or equal to 0°.

15. The outdoor unit according to claim 14, wherein:

the second angle is smaller than or equal to 60°;

the air guide plane is arranged in parallel with the axis of the air guide channel, a distance between the air guide plane and the axis of the air guide channel is smaller than or equal to a radius of the air guide channel and greater than 0; and/or in a radial direction of the air guide channel, the air guide plane has a radial size smaller than a half of a diameter of the air guide channel and greater than 0.

16. The outdoor unit according to claim 13, wherein:

the second flow-disturbance structure is one of N second flow-disturbance structures arranged on the inner wall of the second horn mouth, N being a positive integer larger than or equal to 1;

the fan includes n fan blades, n being a positive integer larger than or equal to 1; and $0.2n<N<50n$.

17. The outdoor unit according to claim 16, wherein:

N is greater than 1, and the N second flow-disturbance structures are arranged at intervals in a circumferential direction of the air guide channel; and/or the N second flow-disturbance structures are cutting plane parts formed on an inner wall surface of the second horn mouth.

* * * * *